US006409400B1

(12) United States Patent
Arai

(10) Patent No.: US 6,409,400 B1
(45) Date of Patent: Jun. 25, 2002

(54) IMAGE RECORDING APPARATUS, LIGHT-SENSITIVE MATERIAL PROCESSING APPARATUS AND IMAGE FORMING APPARATUS

(75) Inventor: Haruhiko Arai, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/178,474

(22) Filed: Oct. 26, 1998

(30) Foreign Application Priority Data

Oct. 24, 1997 (JP) ..... 9-292583

(51) Int. Cl.[7] ..... G03D 3/08; B65H 29/00

(52) U.S. Cl. ..... 396/612; 396/613; 355/28; 271/185; 271/186

(58) Field of Search ..... 396/613, 612; 355/28, 29, 40, 41, 72; 271/185, 186

(56) References Cited

U.S. PATENT DOCUMENTS 5,432,586 A * 7/1995 Tokuda ..... 355/28
5,857,128 A * 1/1999 Matsumoto ..... 396/612
6,040,896 A * 3/2000 Motooka ..... 355/29
6,115,103 A * 9/2000 Iwai ..... 355/40

FOREIGN PATENT DOCUMENTS

GB 2100882 * 1/1983 ..... 396/FOR 942

* cited by examiner

*Primary Examiner*—D Rutledge
(74) *Attorney, Agent, or Firm*—Sughrue Mion, PLLC

(57) ABSTRACT

There are provided an image recording apparatus comprising an exposing device for forming a latent image by imagewise exposure of a light-sensitive material, a transport device for supplying the light-sensitive material into the exposing device and for transporting an as-exposed light-sensitive material into a developing device, and a reversing device for reversing the light-sensitive material being transported such that its advancing end in the direction of transport becomes the trailing end and vice versa and being located in the pathway of transport by the transport device; a light-sensitive material processing apparatus comprising a reversing device upstream of the developing device; and an image forming apparatus comprising one of the two apparatus. These apparatus are capable of consistent production of high-quality prints by substantially reducing the permeation of processing solutions into the light-sensitive material and the color forming due to the damage to its advancing end. Troubles in the exposing section due to paper particles can be also reduced.

20 Claims, 5 Drawing Sheets

IMAGE RECORDING APPARATUS, LIGHT-SENSITIVE MATERIAL PROCESSING APPARATUS AND IMAGE FORMING APPARATUS

BACKGROUND OF THE INVENTION

The present invention relates to the technical field of image recording apparatus that record a latent image on cut sheets of a light-sensitive material by exposure and light-sensitive material processing apparatus that subsequently perform development and other processing on the as-exposed light-sensitive material having the latent image formed thereon, as well as image forming apparatus that use these apparatus.

Heretofore, the image recorded on photographic films such as negatives and reversals (which are hereunder referred to simply as"films") has been commonly printed on light-sensitive materials such as photographic paper by means of direct (analog) exposure, in which projected light from the film is allowed to be incident on the light-sensitive material to achieve its areal exposure.

A new technology has recently been introduced and this is a printer that relies upon digital exposure. Briefly, the image recorded on a film is read photoelectrically, converted to a digital image data (signal) and subjected to various image processing operations to produce image data for recording purposes; recording light such as optical beam that has been modulated in accordance with the image data is used for scan exposure of a light-sensitive material; the light-sensitive material is exposed while transported to thereby record a latent image, which is subsequently developed and output as a print (photograph). The printer operating on this principle has been commercialized as a digital photoprinter.

In the digital photoprinter, the image on a film is read photoelectrically and gradation correction and other operations are performed by subsequent image (signal) processing to determine exposing conditions. Hence, the digital photoprinter has many capabilities in image processing such as editing of printed images by, for example, assembling a plurality of images or splitting a single image into plural images, as well as color/density adjustment and edge enhancement; as a result, prints can be output as needed by specific uses. In addition, the data on a printed image can be supplied into a computer or the like and stored in recording media such as a floppy disk or a hard disk.

A further advantage of the digital photoprinter is that compared to the prints produced by the conventional method of direct exposure, those which are output by the digital photoprinter have better image quality in such aspects as resolution and color/density reproduction.

In the exposing device, whether it is in the digital photoprinter or an ordinary photoprinter that relies upon "direct" exposure, a virgin light-sensitive material is in the form of a magazine, i.e., a roll contained in a lightproof case. The light-sensitive material is withdrawn out of the magazine in the exposing device and further transported for exposure and other necessary steps.

In the ordinary photoprinter, the light-sensitive material being transported is not cut, but remains a web as it is subjected to exposure, back print recording, development, rinse, drying and other necessary steps and only after these steps are complete, the light-sensitive material is cut to individual prints of a specified length.

This process requires that frame information (frame punches) for delineating individual frames (or prints) be formed before or during the exposure of the light-sensitive material. However, the portion of the light-sensitive material where the frame information is formed is simply a waste of space. In addition, frame information have to be formed by special means having a punch, a sensor or the like.

As is well known, the light-sensitive material in the process of digital scan exposure has to be transported at high precision and without stops. Therefore, if the apparatus is of such a type that the light-sensitive material is cut in the last step, a slack portion (loop) has to be formed of it both upstream and downstream of the scanning transport means in order to ensure that the scan transport of the light-sensitive material will not undergo any load variations or will not be brought to frequent stops on account of limitations in some other sites; however, this only complicates the mode of control and pathway of the transport of the light-sensitive material.

One way to deal with this problem in the digital photoprinter is by cutting the light-sensitive material into individual sheets of a size corresponding to one print and thereafter performing exposure, development and other necessary steps. This idea has been commercialized in analog photoprinters.

Nipping with transport roller pairs is a common means of transporting the light-sensitive material in the image recording apparatus, the light-sensitive material processing apparatus and the image forming apparatus of the type contemplated by the present invention. A problem with this transport means is that at the point of time when the light-sensitive material is nipped in a roller pair, its advancing end bumps against the roller pair and frays outward. That is, damage such as delamination or dislodging of color forming layers occurs in the advancing end of the light-sensitive material to be transported. This kind of damage becomes noticeable as the length of transport of the light-sensitive material increases. In particular, in an image forming apparatus that cuts the light-sensitive material into individual sheets of a specified length before it is subjected to exposure, development and other steps, the distance between adjacent transport roller pairs has to be adjusted to correspond to the light-sensitive material of a minimum size and the number of transport roller pairs increases accordingly, with the inevitable result that the advancing end of the light-sensitive material is extensively damaged.

The sharpness of the cutter is also a significant factor and if it does not cut well, the light-sensitive material will be greatly damaged by contact with the transport roller pair, Therefore, the advancing end of the light-sensitive material will be damaged more extensively if it is a cut end than when it is not.

Photographic materials are usually subjected to a wet development process in the light-sensitive material processing apparatus. If a light-sensitive material having a damaged advancing end is subjected to a wet development process, the developer and other processing solutions will permeate through the damaged end, which leads to swelling due to the delamination of the advancing end or color forming due to the dislodging of the color forming layers as exemplified by reddening due to the dislodging of the cyan (C) layer. As the result, the quality of the light-sensitive material (prints) deteriorates and, in an extreme case, the finished prints are not acceptable as soluble products.

SUMMARY OF THE INVENTION

The present invention has been accomplished under these circumstances and has as an object providing an image recording apparatus such as a printer that exposes cut sheets of a light-sensitive material to form a latent image, a light-sensitive material processing apparatus that then performs a wet development process on the as-exposed light-sensitive material to form a visible image and an image forming apparatus provided with these two apparatus, characterized in that the damage of the advancing end of the light-sensitive material being transported, namely, its delamination or dislodging of the color forming layers, is suppressed so that the permeation of processing solutions into the light-sensitive material on account of such troubles is substantially reduced to enable consistent production of high-quality prints.

Another object of the invention is to provide an image recording apparatus such as a printer that experiences fewer troubles in the exposing section due to paper particles.

Yet another object of the invention is to provide an image forming apparatus such as a printer/processor system in which an image recording apparatus is advantageously combined with a light-sensitive martial processing apparatus that allows developed prints (light-sensitive materials) to be easily stacked with the image area facing up.

The first and principal object of the invention can be attained by an image recording apparatus comprising:

an exposing means for forming a latent image by imagewise exposure of a light-sensitive material cut to a specified length;

a transport means for supplying the light-sensitive material into said exposing means and for transporting an as-exposed light-sensitive material into a developing means that performs a wet development process on the as-exposed light-sensitive material which has the latent image formed thereon by said exposing means; and a reversing means for reversing the light-sensitive material being transported such that its advancing end in the direction of transport becomes the trailing end and vice versa and being located in the pathway of transport by said transport means.

Preferably, said reversing means reverses the light-sensitive material by pulling it from the advancing end and delivering it from the trailing end.

Preferably, a surface correcting means that nips and transports the light-sensitive material at a higher pressure than is necessary for its transport is provided at least one of within and downstream of said reversing means.

Preferably, a distributing means for distributing the individual cut sheets of light-sensitive material in a direction perpendicular to the direction of transport by the developing means to form a plurality of transport lines is provided within or downstream of the reversing means.

Preferably, said developing means is adapted to be connectable to the transport means in such a way that the developing means receives the as-exposed light-sensitive material with its emulsion-coated side facing down from the transport means.

Preferably, said light-sensitive material cut to the specified length is supplied as a sheet-like light sensitive material cut previously to the specified length at the outside.

Preferably, the image recording apparatus further comprises a cuter for cutting a withdrawn light-sensitive material from a roll thereof to the specified length, wherein said light-sensitive material cut to the specified length is a sheet-like light-sensitive material that is supplied as a roll thereof and cut to the specified length by said cutter.

Preferably, said transport means comprises at least one transport roller pair for nipping and transporting the light-sensitive material.

The invention also provides an image forming apparatus comprising:

the image recording apparatus according to claim 1, and a light-sensitive material processing apparatus containing the developing means provided downstream of the transport means.

Preferably, said light-sensitive material processing apparatus is connected to the transport means of said image recording apparatus in such a way that said light-sensitive material processing apparatus receives the as-exposed light-sensitive material with its emulsion-coated side face down from the transport means of said image recording apparatus.

Preferably, said exposing means of the image recording apparatus exposes the light-sensitive material from its top side and said light-sensitive material processing apparatus is connected to the image recording apparatus in series in, such a way that the light-sensitive material processing apparatus receives the as-exposed light-sensitive material with its emulsion-coated side facing down from the transport means of the image recording apparatus.

Preferably, said reversing means reverses the light-sensitive material such that the top side becomes a reverse side and vice versa as well as the advancing end becomes the trailing end and vice versa.

The invention further provides a light-sensitive material processing apparatus comprising:

a developing means for performing a wet development process on an as-exposed light-sensitive material which is cut to a specified length and which has a latent image formed thereon by imagewise exposure;

a transport means for receiving the as-exposed light-sensitive material supplied and for transporting the as-exposed light-sensitive material into the developing means; and a reversing means for reversing the as-exposed light-sensitive material being transported such that its advancing end in the direction of transport becomes the trailing end and vice versa and being located in the pathway of transport by said transport means.

The invention still further provides an image forming apparatus comprising:

an image recording apparatus containing an exposing means for forming a latent image by imagewise exposure of a light-sensitive material cut to a specified length; and the light-sensitive material processing apparatus according to claim 13.

The invention yet further provides an image forming apparatus comprising:

an image recording apparatus comprising an exposing means for forming a latent image by imagewise exposure of a light-sensitive material cut to a specified length from its top side and a transport means for supplying the light-sensitive material into said exposing means and for transporting the as-exposed light-sensitive material; and a light-sensitive material processing apparatus comprising a developing means for performing a wet development process on the as-exposed light-sensitive material which has the latent image formed thereon by said exposing means and being provided downstream of the transport means of the image recording apparatus;

wherein said light-sensitive material processing apparatus is connected to the image recording apparatus in series in such a way that the light-sensitive material processing apparatus receives the as-exposed light-sensitive material with its emulsion-coated side facing down from the transport means of the image recording apparatus.

Preferably, said image recording apparatus or said light-sensitive material processing apparatus further comprises a reversing means that is located in the pathway of transport by said transport means and which reverses the light-sensitive material being transported such that its top side becomes a reverse side and vice versa.

Preferably, said reversing means reverses further the light-sensitive material such that its advancing end in the direction of transport becomes the trailing end and vice versa as well as the top side becomes the reverse side and vice versa.

Preferably, said image recording apparatus or said light-sensitive material processing apparatus further comprises a reversing means that is located in the pathway of transport by transport means and which reverses the as-exposed light-sensitive material being transported such that its advancing end in the direction of transport becomes the trailing end and vice versa.

DETAILED DESCRIPTION OF THE INVENTION

The image recording apparatus, light-sensitive material processing apparatus and image forming apparatus of the invention will now be described in detail with reference to the preferred embodiment shown in the accompanying drawings.

Figure 1:
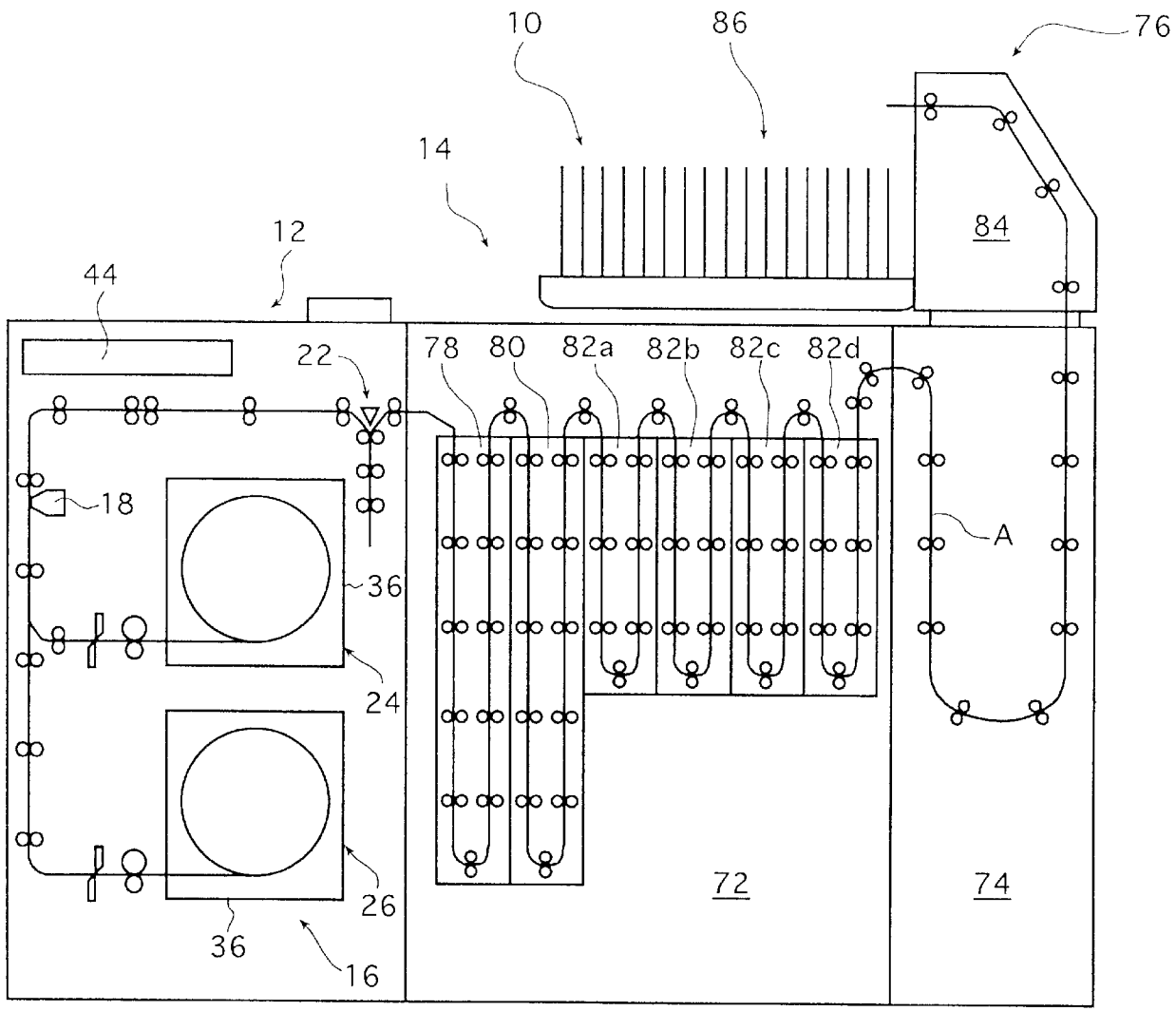
FIG. 1 shows diagrammatically an embodiment of the image forming apparatus of the invention.

FIG. 1 shows diagrammatically an embodiment of the image forming apparatus of the invention.

The image forming apparatus indicated by 10 in FIG. 1 and which is hereinafter simply referred to as the "forming apparatus 10" is the aforementioned digital photoprinter. The apparatus comprises a printer 12 which is the image recording apparatus of the invention and in which a web of light-sensitive material is cut to individual sheets of a specified length associated with the prints to be finally produced, then back printing (recording of a back print) and digital scan exposure are performed, and a processor 14 which is the light-sensitive material processing apparatus and in which the sheets of the light-sensitive material A having a latent image recorded thereon are subjected to a wet development, dried and sorted as (finished) prints.

It should be noted that the illustrated embodiment provides an apparatus to record a latent image on the light-sensitive material by means of digital exposure, but the invention is not limited thereto and also advantageously applicable to an image recording apparatus with direct (analog) exposure in which the light-sensitive material is exposed (printed) by means of projected light from a film. In the illustrated case, a roll of light-sensitive material is cut to individual sheets of a specified length which are used in printing, but cut sheets of light-sensitive material having a specified length which were previously cut in the exterior of the apparatus may be accommodated in a cassette and loaded in the apparatus to be used immediately.

Figure 2:
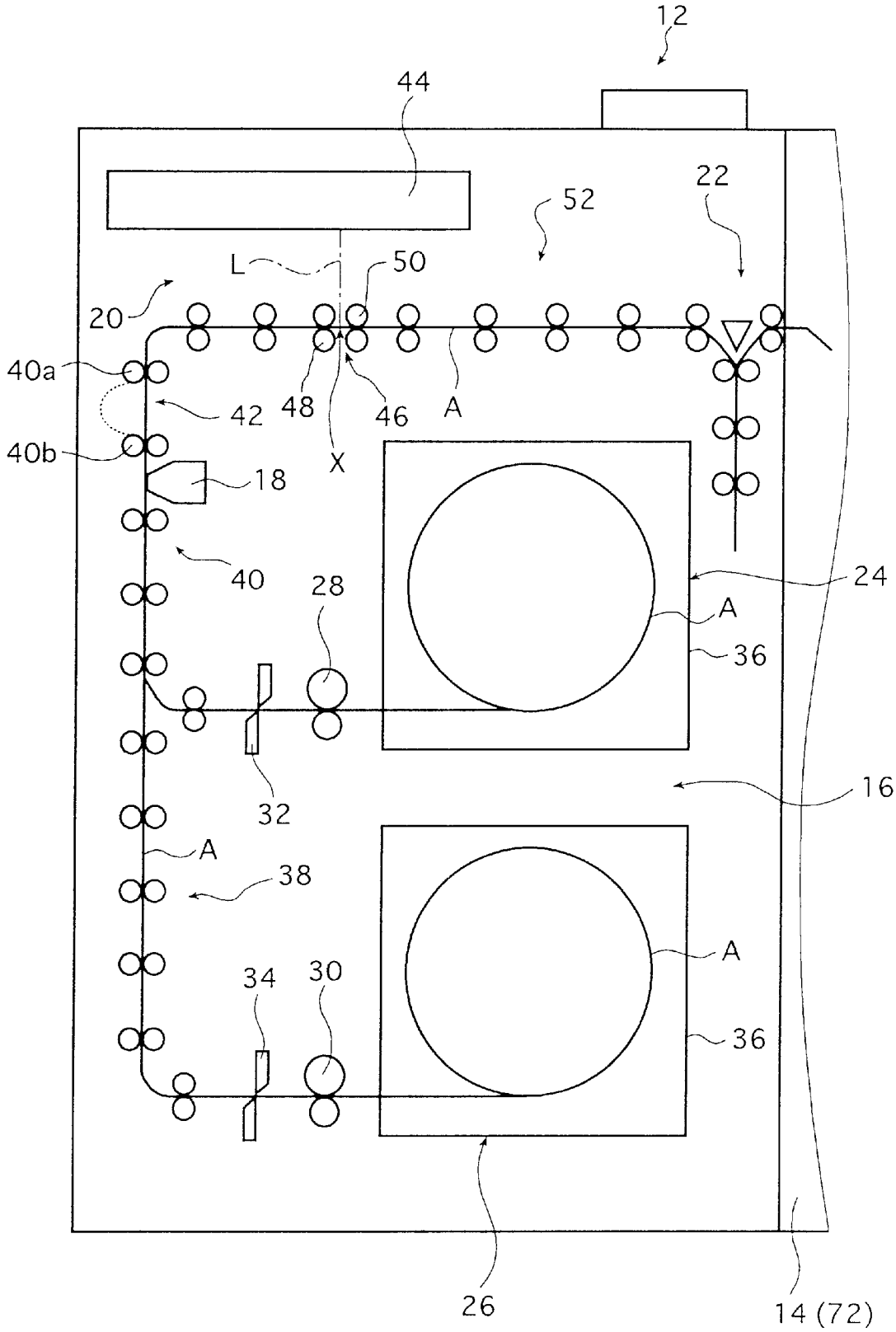
FIG. 2 shows diagrammatically an embodiment of the image recording apparatus in the image forming apparatus shown in FIG. 1.

FIG. 2 shows diagrammatically an embodiment of the printer 12 which is the image recording apparatus of the invention applied to the image forming apparatus 10 of the invention.

The printer 12 comprises a light-sensitive material supply section 16, back print means 18 for back print recording, an image recording section 20 which exposes the light-sensitive material A in a recording (exposing) position X, and a light-sensitive material reversing section. It should be noted that, in addition to the illustrated components, means of transporting the light-sensitive material A such as transport rollers, transport guides, sensors and various other members are also incorporated, as required, in the printer 12.

Further referring to the printer 12, the light-sensitive material supply section 16 (hereinafter referred to as a "supply section 16") comprises loaders 24 and 26, withdrawing roller pairs 28 and 30, and cutters 32 and 34.

The loaders 24 and 26 are sites into which are loaded magazines 36 containing a roll of light-sensitive material A within a lightproof case, with the recording surface side facing outward. The magazines 36 to be loaded into both the loaders 24 and 261 are usually adapted to contain different types of light-sensitive material A which is characterized by their size (width), surface gloss (silk-finish, matte and so forth), specifications (e.g. thickness and base type), and so forth, but the same type of light-sensitive material A may be contained therein. The number of the magazines 36 that can be loaded is by no means limited to two and it may be adapted to be capable of loading only one magazine or three and more magazines depending on the size and structure of the printer 12.

The withdrawing roller pair 28 or 30 is operated to withdraw the light-sensitive material A from the magazine 36 loaded into the corresponding loader 24 or 26 and the withdrawn light-sensitive material is transported. In the illustrated printer 12, the withdrawing roller pairs 28 and are provided in each outlet of the magazines 36, but the invention is not limited thereto and the withdrawing roller pairs 28 and 30 may be fixed in the supply section 16 as separate elements from the magazines 36.

The transport stops at the point of time when the light-sensitive material A has been transported downstream in the direction of transport (hereinafter referred to as "downstream") from the cutter 32 or 34 corresponding to the withdrawing roller pair 28 or 30 by a length corresponding to each of the prints to be produced. Subsequently, the cutter 32 or 34 turns on to cut the light-sensitive material A to individual sheets of a specified length. It should be noted that one cutter can be used in a plurality of loaders.

The light-sensitive material A taken out of the magazine 36 in the loader 26 and cut into individual sheets of a specified length by means of the cutter 34 is transported upward by means of the first transport section 38 and the second transport section 40, each consisting of a number of transport roller pairs. On the other hand, the light-sensitive material A taken out of the magazine 36 in the loader 24 and cut into individual sheets by means of the cutter 32 is transported upward by means of the second transport section 40. Subsequently, these sheets are both transported in the right direction to the image recording section 20 (scanning transport means 46) with the side of the recording surface (or light-sensitive surface where an emulsion is coated) facing upward.

The back print means 18 is located in the middle of the second transport section 40.

The back print means 18 is used to record on a non-record reverse surface of the light-sensitive material A (where no emulsion is coated) a back print consisting of various pieces of information, such as the date when the picture was taken, the date of printing (exposure), frame number, film identification (ID) number (code), ID number of the camera used to take the picture and ID number of the photoprinter. The light-sensitive material A is subjected to back print recording by means of the back print means 18 as it is transported by means of the second transport section 40.

Examples of the back print means 18 for back print recording include back printers for use in known photoprinters such as an ink-jet printer, a dot impact printer and a thermal transfer printer. To be compatible with the recently developed Advanced Photo System, the back print means 18 is preferably adapted to be capable of marking at least two lines at a time.

A loop forming area 42 is provided between the transport roller pairs 40*a* and 40*b* which are downstream of the back print means 18 in the second transport section 40.

Thus, the transport speed of the light-sensitive material A in the second transport section 40 is set as follows: the speed in the transport roller pair 40*a* and subsequent components which are downstream of the loop forming area 42 is the same as the scanning transport speed in the image recording section 20 (scanning transport means 46), whereas the speed in the transport roller pair 40*b* and prior components which are upstream of the loop forming area 42 is higher than the above scanning transport speed. The light-sensitive material A transported through the second transport section 40 forms a loop in the loop forming area 42 in accordance with its size based on the difference in the upstream/downstream transport speed, as shown by the dotted line in FIG. 2.

In the illustrated printer 12, this configuration enables the separation of the back print means 18 from the image recording section 20 with a short path length, whereby a highly precise scanning and transport of the light-sensitive material A in the course of exposure is realized.

The image recording section 20 comprises an exposing unit 44 and scanning transport means 46. The recording light L, modulated in accordance with the image data (recorded image) and which defines the main scanning line perpendicular to the direction in which the light-sensitive material A is transported for scanning, emits from the exposing unit 44 and is incident on the recording position X as the light-sensitive material A is held in a specified recording position X by means of the scanning transport means 46 and transported for scanning, whereupon the light-sensitive material A is exposed by two-dimensional scanning to form a latent image on it.

It should be noted that, in the illustrated image recording section 20,1a side registering (edge position regulation) of the light-sensitive material A is performed so that the center of the light-sensitive material A in its main scanning direction can be set to a specified position; i.e., center-referenced exposure of the light-sensitive material A is performed.

The exposing unit 44 is a known optical beam scanner using the light beams including laser beam as the recording light L. The exposing unit 44 is composed essentially of light sources which issue optical beams for exposing the light-sensitive material A with red (R), green (G) and blue (B) lights, modulating means such as AOM (acoustic optical modulator) which modulates the light beams issued from the light sources in accordance with digital image data, a light deflector such as a polygonal mirror which deflects the modulated light beams in a main scanning direction, an fθ (scanning) lens with which the light beams deflected in the main scanning direction (normal to the plane of FIG. 1) are focused to form beam spot of a specified diameter at a specified point in the recording position X in cooperation with specified beam optics, and so forth.

The exposing unit 44 may be replaced by various kinds of digital exposing means using various arrays of light-emitting devices and spatial modulating devices which extend in a direction,perpendicular to the direction in which the light-sensitive material A is transported for scanning. Specific examples of such arrays include a PDP (plasma display) array, an ELD (electroluminescent display) array, an LED (light-emitting diode) array, an LCD (liquid-crystal display) array, a DMD (digital micromirror device) array, and a laser array.

On the other hand, the scanning transport means 46 comprises two transport roller pairs 48 and 50 that are provided on opposite sides of the recording position X (scanning line), and an exposure guide (not shown) to hold more precisely the light-sensitive material A in the recording position X. The light-sensitive material A is transported for scanning in the auxiliary scanning direction perpendicular to the main scanning direction while it is held in the recording position X. The light beams as the recording light L are deflected in the main scanning direction, so the light-sensitive material A is exposed by two-dimensional scanning with the recording light L modulated in accordance with the image data to thereby form a latentimage on the material.

Another example of the scanning transport means is by using an exposing drum that transports the light-sensitive material A as it is held in the recording position X and two nip rollers which are provided on opposite sides of the recording position X in such a way that they are held in contact with the exposing drum.

The light-sensitive material A having a latent image formed upon exposure is transported by a third transport section 52 composed of a plurality of transport rollers until it reaches the light-sensitive material reversing section 22 located at the most downstream end of the third transport section 52, where it is reversed such that the advancing end becomes the trailing end and vice versa before it is supplied into the processor 14.

The speed of transport in the third transport section 52 is the same as the scanning transport means 46 so that the transport of the light-sensitive material A in the third transport section 52 will notaffect its scan transport. If required, the drive and stop of the most upstream transport roller pair in the third transport section 52, as well as the nipping of the light-sensitive material by that transport roller pair and its release therefrom may be controlled such as to form a loop of the light-sensitive material A between the scanning transport means 46 (particularly the transport roller pair 50) and the third transport section 52 (particularly its most upstream roller pair), thereby ensuring more positive isolation between the scanning transport means 46 and the third transport section 52.

Figure 3A:
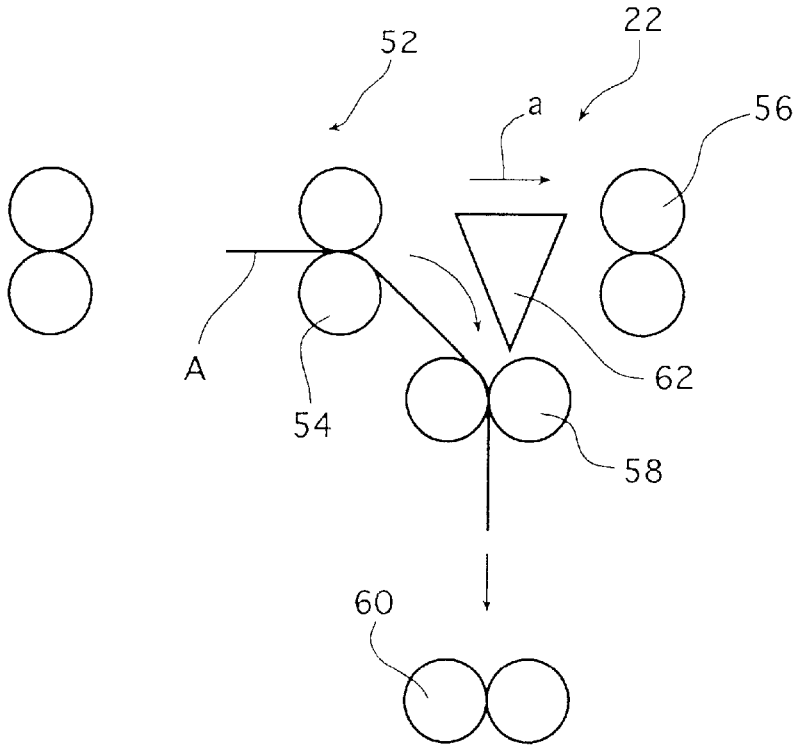
FIGS. 3*a* and 3*b* show diagrammatically an example of the reversing sectionl of the image recording apparatus shown in FIG. 2 in different operation modes.
Figure 3B:
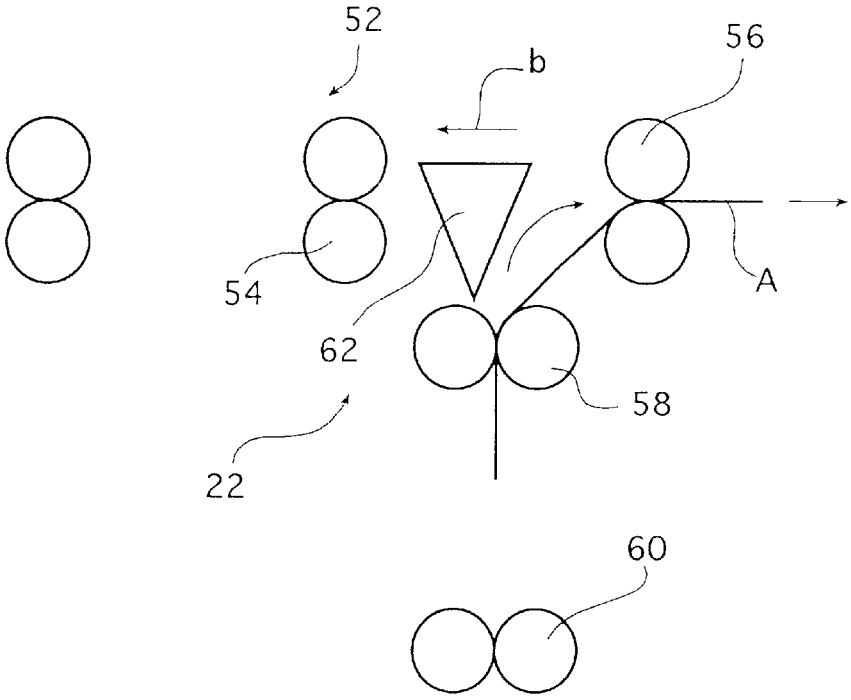

FIGS. 3*a* and 3*b* show an example of the light-sensitive material reversing section 22 (which is hereunder referred to as the "reversing section 22") that is one of the elements characterizing the invention.

The reversing section 22 comprises an upstream take-up roller pair 54, a downstream delivery roller pair 56, transport roller pairs 58 and 60 arranged such that the light-sensitive material A is transported either downwardly or upwardly between the take-up roller pair 54 and the delivery roller pair 56, and a movable guide 62 located between the take-up roller pair 54 and the delivery roller pair 56. In addition to these basic elements, the reversing section 22 may have a guide and any other elements that ensure positive transport of the light-sensitive material A.

In the reversing section 22, the light-sensitive material A coming from the third transport section 52 is transported first downwardly then upwardly by the transport roller pairs 58 and 60. Thus, the light-sensitive material is transported by a so-called "switchback" mechanism such that its advancing end becomes the trailing end and vice versa. It should be noted that in the illustrated reversing section 22, the light-sensitive material A is reversed such that its advancing end becomes the trailing end and vice versa, and at the same time its top side (or light-sensitive surface where an emulsion is coated) becomes the reverse side (or non light-sensitive surface where no emulsion is coated) and vice versa.

The movable guide 62 may typically assume an inverted equilateral triangle and is driven by a known means to move in the direction of either arrow a or b parallel to the direction of transport such that it departs from the take-up roller pair 54 and comes closer to the delivery roller pair 56 or vice versa,.

Both the take-up roller pair 54 and the delivery roller pair 56 are driven such that the light-sensitive material A is transported downwardly, whereas the transport roller pairs 58 and 60 are capable of rotating in both forward and reverse directions.

As shown in FIG. 3*a,* when the light-sensitive material A coming from the third transport section 52 is fed into the reversing section 22, the movable guide 62 shifts in the direction of arrow a to move closer to the delivery roller pair 56 so that its lower edge is located closer to the delivery roller pair 56 than to the nip of the transport roller pair 58. As the result, the light-sensitive material A being transported by the take-up roller pair 54 is guided by the movable guide 62 to be fed into the transport roller pair 58 so that it is transported downward (pulled down). by means of the transport roller pairs 58 and 60.

When the trailing end of the light-sensitive material A has reached a point that is at least lower than the bottom edge of the movable guide 62, the transport roller pairs 58 and 60 stop transporting the light-sensitive material. Then as shown in FIG. 3*b,* the movable guide 62 shifts in the direction of arrow b to move closer to the transport roller pair 54 so that its lower edge is located closer to the transport roller pair 54 than to the nip of the transport roller pair 58.

Subsequently, the transport roller pairs 58 and 60 rotate in reverse direction, whereupon the trailing end of the light-sensitive material A becomes the advancing end and it is transported (delivered) upward to be fed into the delivery roller pair 56 by means of the movable guide 62 with its bottom edge located closer to the transport roller pair 54. Thus, the light-sensitive material A is reversed in the reversing section 22 (its advancing end becomes the trailing end and vice versa) before it is supplied into the developing section 72 of the processor 14.

As already mentioned, in the conventional image forming apparatus, the advancing end of the light-sensitive material A being transported by a number of transport roller pairs has been frayed outward due to repeated collision with transport roller pairs which results in delamination of the advancing end or dislodging of color forming layers, and if it is immediately subjected to a wet development process, the processing solutions will permeate through the damaged advancing end of the light-sensitive material A to such an extent that swelling or color forming (for example, reddening) of the light-sensitive material A leading to print quality deterioration occurs.

In contrast, according to the apparatus of the present invention in which the light-sensitive material A is supplied to wet development processing means (which, in the illustrated case, is a color developing tank 78 in the developing section 72 of the processor 14) after it has been reversed such that the advancing end becomes the trailing end and vice versa (in the illustrated case, the printer 12 or the image forming apparatus 10 using the printer 12), the light-sensitive material A is subjected to development and subsequent processing with its damaged advancing end becoming the trailing end, so the new trailing end and its nearby area is "ironed" by the transport and other actions of the transport roller pairs in the developing section 72, whereby the aforementioned fray is remedied and the permeation of the processing solutions into that damaged portion and dislodging of the color forming layers are markedly reduced. In addition, the new advancing end of the light-sensitive material was the trailing end before it was reversed in the reversing section 22, so it was damaged too little to cause a significant permeation of the processing solutions.

Thus, using the image recording apparatus of the invention and the image forming apparatus using the image recording apparatus, one can produce high-quality prints in a consistent manner that the permeation of the processing solutions and dislodging of the color forming layers are markedly reduced.

The means of reversing the light-sensitive material A such that its advancing end becomes the trailing end and vice versa and its top side becomes the reverse side and vice versa by a "switchback" mechanism is not limited to the illustrated case and various other arrangements may be adopted.

Figure 4:
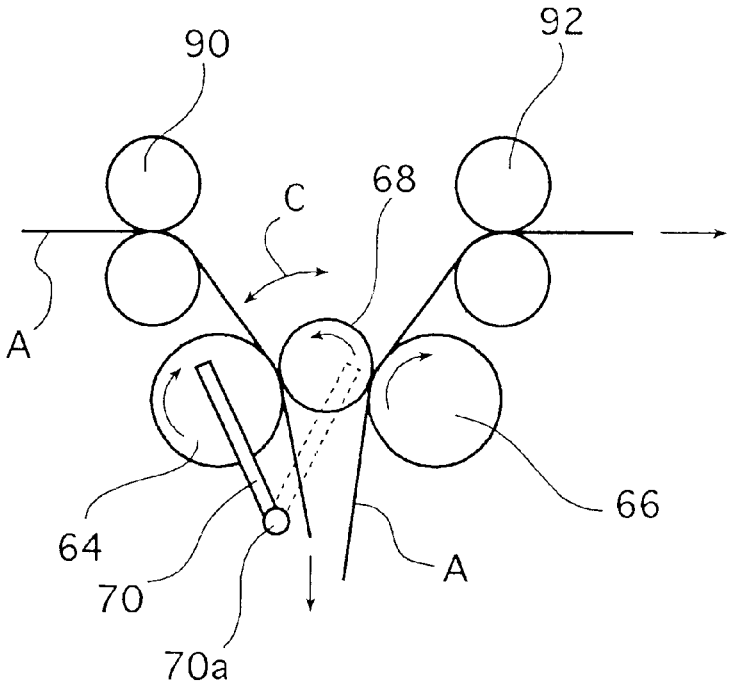
FIG. 4 shows diagrammatically another example of the reversing means used in the image recording apparatus of the invention.

FIG. 4 shows another example of the reversing means that adopts a switchback mechanism. The reversing means shown in FIG. 4 comprises an upstream take-up roller 64, a downstream delivery roller 66, an intermediate roller 68 that contacts both rollers 64 and 66 in an upper position, and a comb-shaped guide 70. Each of the rollers 64, 66 and 68 is a split roller that consists of segments arranged along the longitudinal axis and the teeth of the combshaped guide 70 are inserted between the individual segments. Shown by 90 and 92 are transport roller pairs.

As in the case shown in FIGS. 3*a* and 3*b,* the reversing means shown in FIG. 4 may optionally have a guide and other elements that assure more positive transport of the light-sensitive material A.

As shown by arrows, the take-up roller 64, the delivery roller 66 and the intermediate roller 68 rotate such that the light-sensitive material A is nipped and transported downward (pulled down) by the take-up roller 64 and the intermediate roller 68 whereas it is nipped and transported upward by the intermediate roller 68 and the delivery roller 66.

The comb-shaped guide 70 is axially supported at the lower end on a fulcrum 70*a* such that it is pivotal as indicated by arrow c to take either one of the following two positions: the position indicated by a solid line where the guide 70 retracts from the pathway of transport of the light-sensitive material A and the position indicated by a dashed line where the light-sensitive material A coming upward is guided to the nip between the intermediate roller 68 and the delivery roller 66.

The advantage of the reversing means shown in FIG. 4 is that the delivery of the light-sensitive material A from the reversing means can be effected simultaneously with its feeding into the reversing means, whereby the distance between successively supplied sheets of light-sensitive material A, namely, the interval between exposures, can be sufficiently shortened to enable efficient print production.

Stated more specifically, if the light-sensitive material A is to be delivered from the reversing means, the comb-shaped guide 70 is shifted to the position indicated by the dashed line and the light-sensitive material A is guided to the nip between the intermediate roller 68 and the delivery roller 66. When the light-sensitive material A is nipped between the two rollers, the guide 70 is pivoted to the retracted position indicated by the solid line, making it possible to feed the next sheet of light-sensitive material A into the nip between the take-up roller 64 and the intermediate roller 68. In this way, the light-sensitive material A can be delivered from the reversing means and fed into it simultaneously.

In order to have the light-sensitive material A delivered from the reversing means, it must be supplied into the nip between the intermediate roller 68 and the delivery roller 66 and this may be accomplished by an enclosure with a vertically movable bottom that receives the light-sensitive material A which has been fed into the reversing means, said enclosure being positioned beneath the two rollers such that it pushes up the received light-sensitive material A to be supplied into the nip between the rollers.

Alternatively, transport means such as transport roller pairs 58 and 60 in the reversing section 22 shown in FIGS. 3*a* and 3*b* may be provided in such a way that they are capable of moving closer to or away from each other. In this case, the light-sensitive material A is nipped and transported upward by said transport roller pairs to be supplied into the nip between the intermediate roller 68 and the delivery roller 66 and at the same time as the comb-shaped guide 70 is brought to the retracted position, the transport roller pairs are allowed to depart from each other so that the light-sensitive material A can be nipped between the two rollers. In this alternative case, it is preferred to provide a stopper for preventing the light-sensitive material A from dropping when it is being fed into the reversing means, as well as a guide for guiding and retaining the light-sensitive material A between the rollers that were allowed to depart from each other.

It should also be noted that the means of reversing the light-sensitive material A in the present invention such that its advancing end becomes the trailing end and vice versa is by no means limited to the reversing means as exemplified by the switchback mechanism shown in FIGS. 3*a,* 3*b* and 4, and the reversing means may have any form, any geometry and any mechanism, as far as the light-sensitive material A can be reversed such that its advancing end becomes the trailing end and vice versa. That is, the reversing means may be the one in which the advancing end becomes the trailing end and vice versa, and at the same time, its top side becomes the reverse side and vice versa, or the one in which the advancing end becomes the trailing end and vice versa, but the top and reverse sides remain unchanged. For example, reversing means such as a turret and a turntable may be used to reverse the light-sensitive material A such that the advancing end becomes the trailing end and vice versa, but the top and reverse sides thereof remain unchanged.

In a preferred embodiment of the printer 12 of the invention, a surface correcting roller pair that nips and transports the light-sensitive material A at a higher-than-usual pressure to remedy the fray that has occurred in it upon repeated collision with transport roller pairs may be provided as an additional element within or downstream of the reversing means. This embodiment is capable of reducing the permeation of processing solutions in a more effective way.

If the surface correcting roller pair is to be provided within the reversing means such as the reversing section 22 shown in FIGS. 3*a* and 3*b,* the delivery roller pair 56 may be used as such surface correcting roller pair. Alternatively, if it is to be provided downstream of the reversing means, one or more of the transport roller pairs that are disposed downstream of the reversing section 22 such as the transport roller pair 92 in the reversing means shown in FIG. 4 may be used as such surface correcting roller pair that is capable of nipping the light-sensitive material at a higher-than-usual pressure.

For several reasons such as the greater effectiveness in reducing the permeation of processing solutions, the nip pressure of the surface correcting roller pair is preferably at least three times as high as the nip pressure to be exerted by ordinary transport roller pairs. However, an excessively high pressure is a cause of pressure fog in the light-sensitive material A. Therefore, the total pressure to be exerted by surface correcting roller pairs is preferably not higher than 6 kgf.

The processor 14 which is the light-sensitive material processing apparatus applied to the image forming apparatus 10 of the invention as shown in FIG. 1 comprises the developing section 72, a drying section 74 and a sorting section 76. The developing section 72 comprises a color developing tank 78, a bleach-fixing tank 80 and rinse tanks 82 (82*a,* 82*b,* 82*c* and 82*d*); the as-exposed light-sensitive material A that has been supplied from the reversing section 22 of the printer 12 to the processor 14 is immersed in the respective tanks in the order written so that it is subjected to a specified wet development process.

The drying section 74 is a site at which the light-sensitive material is dried with warm air, a heater or by some other suitable drying means; the light-sensitive material A processed in the developing section 72 is dried in the drying section 74 to produce (finished) prints that are then transported to the sorting section 76.

The sorting section 76 has a delivery unit 84 and a sorter 86; the as-dried light-sensitive material A is transported from the delivery unit 84 into the sorter 86, where the individual sheets are sorted in a specified unit, for example, a roll of film and piled in stacks.

Figure 5:
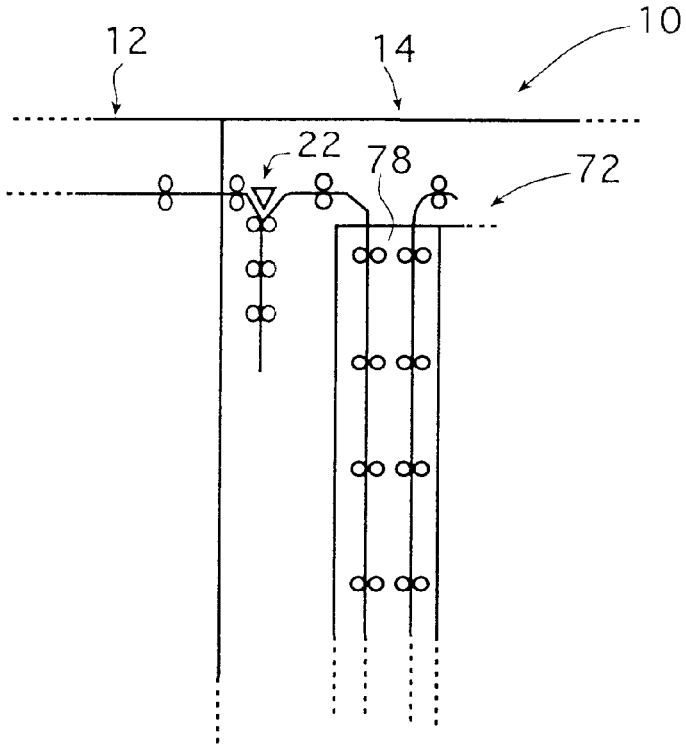
FIG. 5 is a partially enlarged diagrammatic view of an embodiment of the light-sensitive material processing apparatus in the image forming apparatus of the invention.

In the illustrated apparatus, the reversing means is located at the most downstream end of the printer 12 but this is not the sole case of the invention and it may be provided somewhere in the pathway of transport through the third transport section 52. Alternatively, the reversing means may be provided upstream of the image recording section 20 or it may be provided within the processor 14 and upstream of the color developing tank 78, as shown in FIG. 5. In short, the reversing means to be used in the present invention needs only to be provided at a stage prior to the immersion of the light-sensitive material A in the processing tank for wet processing, in the illustrated case, the first located color developing tank 78.

It should however be noted that the reversing means is preferably provided at the most possible downstream end because this is more effective for the purpose of reducing the permeation of processing solutions into the light-sensitive material and the dislodging of the color forming layers due to the damage of its advancing end.

The above-mentioned embodiments refer to the image forming apparatus 10 comprising the printer 12 and the processor 14, one of which has the reversing means characterizing the invention. However, this s not the sole case of the invention and the image forming apparatus 10 may be provided with only one of the printer 12 and the processor 14.

Figure 6:
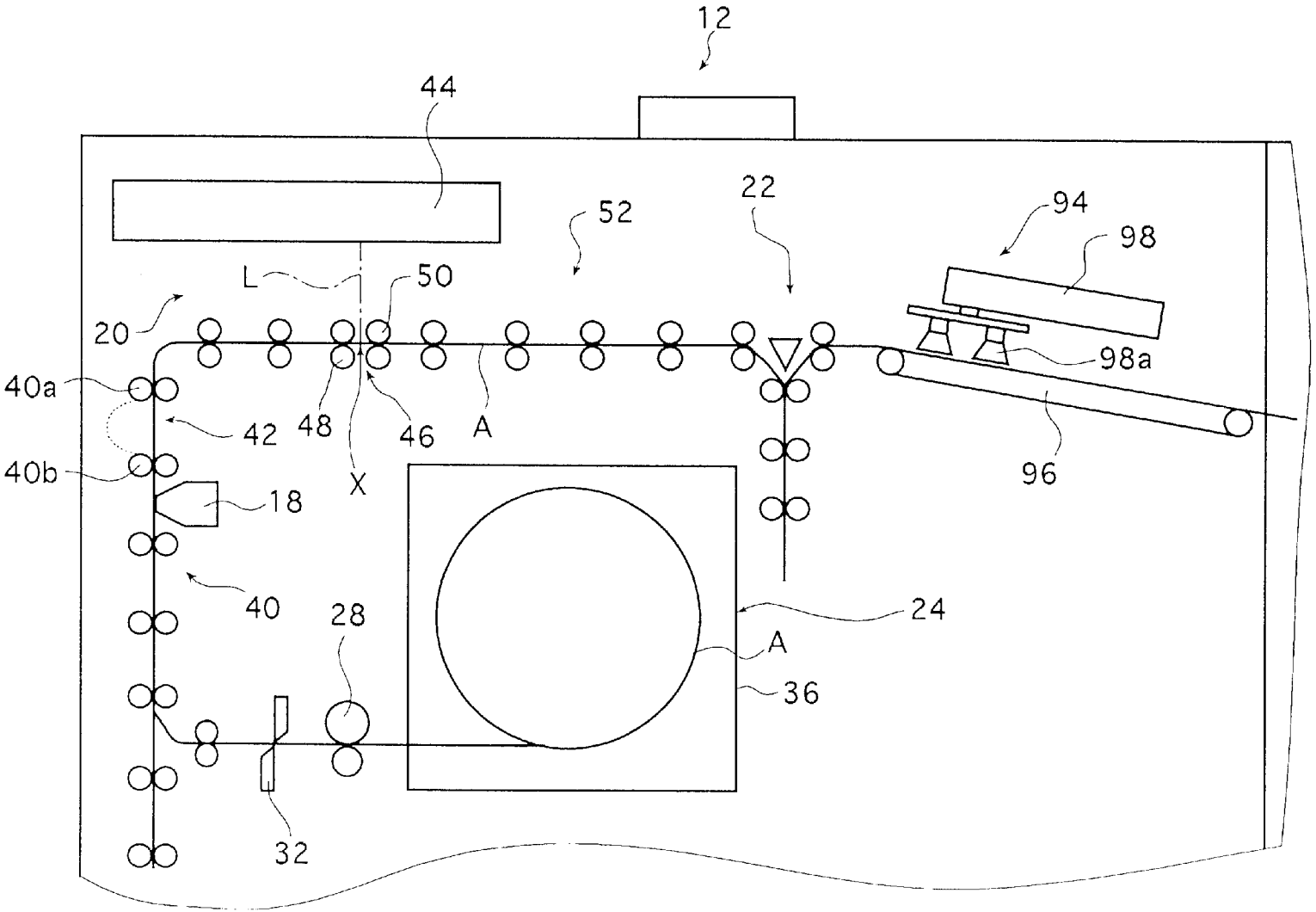
FIG. 6 is a partial diagrammatic view of another embodiment of the image recording apparatus in the image forming apparatus shown FIG. 1.

If necessary, distributing means 94 that distributes individual sheets of the light-sensitive material A sidewise, or in a direction perpendicular to the direction of its transport to form a plurality of rows that overlap in the direction of transport may be provided downstream of the image recording section 20 of the printer 12, as shown in FIG. 6. The distributing means 94 shown in FIG. 6 comprises a belt conveyor 96 by which the as-exposed light-sensitive material A is transported, and lift transport means 98 which hoists the light-sensitive material A by means of suckers 98*a* on the belt conveyor 96 and transports the light-sensitive material A sidewise or in the direction perpendicular to the direction in which the light-sensitive material A is transported thereby distributing in a plurality of rows. By this distributing means 94, the throughput of the processor 14 can be almost doubled in two rows and tripled in three rows and any time difference between exposure and development processing can be practically canceled.

It should however be noted that reversing the individual sheets of light-sensitive material A after they were distributed into a plurality of rows involves several difficulties such as the increased complexity in control and the need for providing more than one reversing section; in view of these difficulties, the distributing means 94 is preferably provided downstream of the reversing sections 22.

The distributing means that can be used in the invention is not limited to any particular type and it may comprise the belt conveyor 96 as transport means and the lift transport means 98 that uses the suckers 98*a* or the like to hoist and transport the individual sheets of light-sensitive material A and distribute them sidewise, as seen in the distributing means 94 shown in FIG. 6. The examples of the distributing means also include the one using a turntable and the one which can be moved two-dimensionally by means of a ball and a roller.

While the image recording apparatus, light-sensitive material processing apparatus and image forming apparatus of the invention have been described above in detail with reference to some embodiments, it should be noted that the invention is by no means limited to the foregoing cases and various improvements and modifications in design may of course be made without departing from the scope and spirit of the invention.

Thus, according to the present invention, there is provided an image recording apparatus that performs imagewise exposure of cut sheets of a light-sensitive material to form a latent image, a light-sensitive material processing apparatus that performs a well developing process on the light-sensitive material having the latent image formed thereon, as well as an image forming apparatus provided with these two apparatus which are capable of consistent production of high-quality prints by substantially reducing the permeation of processing solutions into the light-sensitive material and the color forming due to the damage to its advancing end that has occurred on account of repeated collisions with transport means such as transport roller pairs, for example, the delamination of the advancing end or the dislodging of the color forming layers.

According to the present invention, troubles in the exposing section due to paper particles can be also reduced.

Furthermore, the present invention can provide an advantageous image forming apparatus as a product in which an image recording apparatus is combined with a light-sensitive material processing apparatus, since finished prints (light-sensitive materials) subjected to a wet developing process and output from the light-sensitive material processing[]apparatus can be easily stacked with the image surface facing up.

What is claimed is:

1. An image recording apparatus comprising:

an exposing unit which forms a latent image by imagewise exposure of a light-sensitive material cut to a specified length;

a transport section which supplies the light-sensitive material into said exposing unit and for transporting an as-exposed light-sensitive material into a developing means that performs a wet development process on the as-exposed light-sensitive material which has the latent image formed thereon by said exposing unit; and a reversing section which reverses the light-sensitive material being transported such that an advancing end of said light-sensitive material in the direction of transport becomes a trailing end, said reversing section being located in said transport section.

2. The image recording apparatus according to claim 1, wherein said reversing section reverses the light-sensitive material by pulling it from the advancing end and delivering it from the trailing end.

3. The image recording apparatus according to claim 1, wherein a surface correcting means for nipping and transporting the light-sensitive material at a higher pressure than is necessary for its transport is provided at least one of within and downstream of said reversing section.

4. The image recording apparatus according to claim 1, wherein a distributing means for distributing individual cut sheets of light-sensitive material in a direction perpendicular to the direction of transport by the developing means to form a plurality of transport lines is provided within or downstream of the reversing section.

5. The image recording apparatus according to claim 1, wherein said developing means is adapted to be connectable to the transport section in such a way that the developing means receives the as-exposed light-sensitive material with its emulsion-coated side facing down from the transport section.

6. The image recording apparatus according to claim 1, wherein said light-sensitive material cut to the specified length is supplied as a sheet-like light sensitive material cut previously to the specified length at the outside.

7. The image recording apparatus according to claim 1, further comprising a cutter for cutting a withdrawn light-sensitive material from a roll thereof to the specified length, wherein said light-sensitive material cut to the specified length is a sheet-like light-sensitive material that is supplied as a roll thereof and cut to the specified length by said cutter.

8. The image recording apparatus according to claim 1, wherein said transport section comprises at least one transport roller pair for nipping and transporting the light-sensitive material.

9. An image forming apparatus comprising:

the image recording apparatus according to claim 1, and a light-sensitive material processing apparatus containing the developing means provided downstream of the transport section.

10. The image forming apparatus according to claim 9, wherein said light-sensitive material processing apparatus is connected to the transport section of said image recording apparatus in such a way that said light-sensitive material processing apparatus receives the as-exposed light-sensitive material with its emulsion-coated side face down from the transport section of said image recording apparatus.

11. The image forming apparatus according to claim 9, wherein said exposing unit of the image recording apparatus exposes the light-sensitive material from its top side and said light-sensitive material processing apparatus is connected to the image recording apparatus in series in such a way that the light-sensitive material processing apparatus receives the as-exposed light-sensitive material with its emulsion-coated side facing down from the transport section of the image recording apparatus.

12. The image forming apparatus according to claim 11, wherein said reversing section reverses the light-sensitive material such that a top side of said light-sensitive material becomes a reverse side.

13. A light-sensitive material processing apparatus comprising;

a developing means for performing a wet development process on an as-exposed light-sensitive material which is cut to a specified length and which has a latent image formed thereon by imagewise exposure;

a transport means for receiving the as-exposed light-sensitive material supplied and for transporting the as-exposed light-sensitive material into the developing means; and a reversing means for reversing the as-exposed light-sensitive material being transported such that an advancing end of said light-sensitive material in the direction of transport becomes a trailing end, said reversing means being located in said transport means.

14. An image forming apparatus comprising:

an image recording apparatus containing an exposing means for forming a latent image by imagewise exposure of a light-sensitive material cut to a specified length; and the light-sensitive material processing apparatus according to claim 13.

15. An image forming apparatus comprising;

an image recording apparatus comprising an exposing means for forming a latent image by imagewise exposure of a light-sensitive material cut to a specified length from its top side and a transport means for supplying the light-sensitive material into said exposing means and for transporting the as-exposed light-sensitive material; and a light-sensitive material processing apparatus comprising a developing means for performing a wet development process on the as-exposed light-sensitive material which has the latent image formed thereon by said exposing means and being provided downstream of the transport means of the image recording apparatus;

a reversing means for reversing the light-sensitive material such that an advancing end of said light-sensitive material in the direction of transport becomes a trailing end;

wherein said light-sensitive material processing apparatus is connected to the image recording apparatus in series in such a way that the light-sensitive material processing apparatus receives the as-exposed light-sensitive material with is emulsion-coated side facing down from the transport means of the image recording apparatus.

16. The image forming apparatus according to claim 15, wherein said image recording apparatus or said light-sensitive material processing apparatus further comprises a reversing means that is located in the pathway of transport by said transport means and which reverses the light-sensitive material being transported such that its top side becomes a reverse side and vice versa.

17. The image forming apparatus according to claim 16, wherein said reversing means reverses further the light-sensitive material such that its advancing end in the direction of transport becomes the trailing end and vice versa as well as the top side becomes the reverse side and vice versa.

18. The image forming apparatus according to claim 15, wherein said image recording apparatus or said light-sensitive material processing apparatus further comprises a reversing means that is located in the pathway of transport by transport means and which reverses the as-exposed light-sensitive material being transported such that its advancing end in the direction of transport becomes the trailing end and vice versa.

19. A light-sensitive material processing apparatus comprising;

a developer which performs a wet development process on an as-exposed light-sensitive material which is cut to a specified length and which has a latent image formed thereon by imagewise exposure;

a transport section which receives the as-exposed light-sensitive material supplied and for transporting the as-exposed light-sensitive material into the developing means; and a reversing section which reverses the as-exposed light-sensitive material being transported such that an advancing end of said light-sensitive material in the direction of transport becomes a trailing end, said reversing section being located in said transport section.

20. An image forming apparatus comprising;

an image recording apparatus comprising an exposing unit which forms a latent image by imagewise exposure of a light-sensitive material cut to a specified length from its top side and a transport section which supplies the light-sensitive material into said exposing unit and for transporting the as-exposed light-sensitive material; and a light-sensitive material processing apparatus comprising a developing unit which performs a wet development process on the as-exposed light-sensitive material which has the latent image formed thereon by said exposing unit and being provided downstream of the transport section of the image recording apparatus;

a reverser which reverses the light-sensitive material such that an advancing end of said light-sensitive material in the direction of transport becomes a trailing end;

wherein said light-sensitive material processing apparatus is connected to the image recording apparatus in series in such a way that the light-sensitive material processing apparatus receives the as-exposed light-sensitive material with its emulsion-coated side facing down from the transport section of the image recording apparatus.

* * * * *